US012571552B2

(12) United States Patent
Palmer et al.

(10) Patent No.: US 12,571,552 B2
(45) Date of Patent: Mar. 10, 2026

(54) DIGITAL CONTROLLER FOR AIR CONDITIONER USED IN ENCLOSURE COOLING

(71) Applicant: Ice Qube, Inc., Greensburg, PA (US)

(72) Inventors: Jeffrey Scott Palmer, Greenburg, PA (US); Ridge Altman, Greensburg, PA (US)

(73) Assignee: Ice Qube, Inc., Greensburg, PA (US)

( * ) Notice: Subject to any disclaimer, the term of this patent is extended or adjusted under 35 U.S.C. 154(b) by 545 days.

(21) Appl. No.: 17/850,539

(22) Filed: Jun. 27, 2022

(65) Prior Publication Data

US 2022/0412589 A1 Dec. 29, 2022

Related U.S. Application Data

(60) Provisional application No. 63/215,113, filed on Jun. 25, 2021.

(51) Int. Cl.

| | |
|---|---|
| ***F24F 11/30*** | (2018.01) |
| ***F24F 11/58*** | (2018.01) |
| ***F24F 11/63*** | (2018.01) |
| *F24F 140/00* | (2018.01) |

(52) U.S. Cl.

CPC ..... *F24F 11/30* (2018.01); *F24F 11/58* (2018.01); *F24F 11/63* (2018.01); *F24F 2140/00* (2018.01)

(58) Field of Classification Search

CPC .. F24F 11/30; F24F 11/58; F24F 11/63; F24F 2140/00; F24F 11/38

See application file for complete search history.

(56) References Cited

U.S. PATENT DOCUMENTS

| | | | | |
|---|---|---|---|---|
| 10,292,305 | B2 | 5/2019 | Gruebel | |
| 2002/0035495 | A1* | 3/2002 | Spira | G06Q 10/0637 705/7.36 |
| 2007/0030650 | A1* | 2/2007 | Madara | H05K 7/20572 361/695 |
| 2008/0223943 | A1* | 9/2008 | Mulhouse | F24F 11/52 236/49.3 |
| 2012/0101637 | A1* | 4/2012 | Imes | H04L 43/08 700/278 |
| 2014/0262134 | A1* | 9/2014 | Arensmeier | F24D 5/12 165/11.2 |
| 2017/0038109 | A1* | 2/2017 | De Felice | F24F 11/65 |
| 2017/0328625 | A1* | 11/2017 | Fujimoto | F24F 11/38 |
| 2018/0335220 | A1* | 11/2018 | Matambo | F24F 11/74 |
| 2019/0003734 | A1* | 1/2019 | Costa | F24F 11/38 |
| 2019/0323766 | A1* | 10/2019 | Poolman | B60H 1/00428 |
| 2022/0282897 | A1* | 9/2022 | Gopalnarayanan | F25B 13/00 |

* cited by examiner

*Primary Examiner* — Christopher E. Everett

(74) *Attorney, Agent, or Firm* — Gabriel & Co; Andrew M. Gabriel

(57) ABSTRACT

An example implementation includes a method of monitoring and controlling an air conditioning unit. An example method includes obtaining, from a sensor disposed in an air conditioning unit, data indicative of one or more of current and vibration associated with a physical component of the air conditioner; analyzing, using one or more of a processor and a circuit, the data; determining, based on the analyzing, that the data indicates that the physical component may fail; and providing, responsive to the determining, an indication of failure.

11 Claims, 4 Drawing Sheets

DIGITAL CONTROLLER FOR AIR CONDITIONER USED IN ENCLOSURE COOLING

CROSS-REFERENCE TO RELATED APPLICATIONS

This application claims priority to U.S. provisional patent application Ser. No. 63/215,113, having the same title and filed on Jun. 25, 2021, the contents of which are incorporated by reference herein.

BACKGROUND

Industry and manufacturing have emerged with the widespread use of enclosures for a variety of items, for example electronics or other items that require protection from the elements as well as cooling. To protect these items from harsh environments, they are typically placed in sealed enclosures or workstations that permit efficient operation without the threat of being exposed to exterior contaminates including dust, residue, rain and liquids that have the potential to cause serious damage. Since the items (such as electronics used in the telecommunications industry or like equipment) often generate heat within the enclosure, various cooling equipment such as air conditioners, heat exchangers, in-line compressed air coolers and filtered fan systems are used to maintain required operating temperatures within the enclosure. In some cases, such cooling equipment may be provided as an addition to the enclosure, e.g., a cooling system may be provided separately and attached to an enclosure.

BRIEF SUMMARY

The subject matter disclosed herein relates to enclosure cooling systems and related techniques. Some of the subject matter disclosed herein relates to a digital controller for a cooling system that is mounted to an enclosure and used for cooling items within the enclosure, such as heat generating components or other contents within the enclosure.

Since items in an enclosure (such as electronics used in communication, computation, displaying data, dispensing mechanisms or like equipment and/or items in the enclosure, e.g., to be dispensed) often generate heat within an enclosure or otherwise need to be cooled, such as items in a vending or dispensing machine, various cooling equipment such as air conditioners, heat exchangers, in-line compressed air coolers and filtered fan systems may be used to maintain required operating temperatures within the enclosure.

An embodiment provides an air conditioner that utilizes a housing fitted to an enclosure. An embodiment provides cooling to the enclosure and its contents while allowing for wired or wireless control of the air conditioning unit via a digital controller. An embodiment may be mounted on the outside of an enclosure to be cooled, e.g., on the top of or inside of the enclosure. One or more cutouts on the enclosure interface(s) with one or more intake(s) and return(s) on the air conditioning unit, facilitating circulation or provision of cooling to the enclosure interior.

In summary, an embodiment provides a method, comprising: obtaining, from a sensor disposed in an air conditioning unit, data indicative of one or more of current and vibration associated with a physical component of the air conditioner; analyzing, using one or more of a processor and a circuit, the data; determining, based on the analyzing, that the data indicates that the physical component may fail; and providing, responsive to the determining, an indication of failure.

The method may include the indication being provided to one or more remote devices over an internet connection.

The method may comprise receiving configuration data for configuring one or more set points for the air conditioning unit. The configuration data may be received from a mobile device. The configuration data may be derived from one or more templates associated with one or more predetermined operating scenarios. The one or more predetermined operating scenarios may comprise a lead-lag operating scenario. The configuration data may be received via manual input. The manual input may configure one or more dip switches and or provide configuration input to a controller interface such as a touch screen interface. In one example, the configuration data is received responsive to brining a predetermined mobile device into proximity of the air conditioning unit.

In an embodiment, the analyzing of the sensor data comprises one or more of comparing the data to one or more thresholds and detecting a pattern or trend in the data.

An embodiment includes a device for implementing the various techniques described herein. In one example, the device, comprises: a component including one or more of a fan and a compressor; a sensor configured to monitor the component; and a controller operatively coupled to the component; the controller configured to: obtain, from the sensor, data indicative of one or more of current and vibration associated with the component; analyze the data; determine, based on analyzing the data, that the data indicates that the component may fail; and thereafter provide an indication of failure.

The device may provide the indication to one or more remote devices over an internet connection. In one example, the controller is configured to receive configuration data for configuring one or more set points for the device. The configuration data may be received from a mobile device. The configuration data received from the mobile device may be derived from one or more templates associated with one or more predetermined operating scenarios. The one or more predetermined operating scenarios may comprise a lead-lag operating scenario.

The device may be configured to receive the configuration data via manual input. The device may comprise one or more dip switches, wherein the manual input configures the one or more dip switches. In one example, the controller of the device is configured to detect the configuration data responsive to brining a predetermined mobile device into proximity of the device.

A further embodiment provides a system, comprising: a device as described herein; and a mobile application comprising one or more templates for receiving configuration data associated with one or more predetermined operating scenarios.

A yet further embodiment comprises a product comprising computer executable code configured to implement one or more of the functions or acts specified herein.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the claims but is merely representative of those embodiments.

Reference throughout this specification to "embodiment(s)" (or the like) means that a particular feature, structure, or characteristic described in connection with the embodiment is included in at least one embodiment. Thus, appearances of the phrases "according to embodiments" or "in an embodiment" (or the like) in various places throughout this specification are not necessarily all referring to the same embodiment.

Furthermore, the described features, structures, or characteristics may be combined in any suitable manner in one or more embodiments. In the following description, numerous specific details are provided to give a thorough understanding of example embodiments. One skilled in the relevant art will recognize, however, that aspects can be practiced without one or more of the specific details, or with other methods, components, materials, etc. In other instances, well-known structures, materials, or operations are not shown or described in detail to avoid obfuscation.

The description now turns to the figure(s), which illustrate certain example embodiments. The dimensions and other numerical information provided herein, including in the figures, are provided only by way of example and are not limiting unless specifically included in a claim. In the figure(s), certain example dimensions are provided in millimeters.

Figure 1:
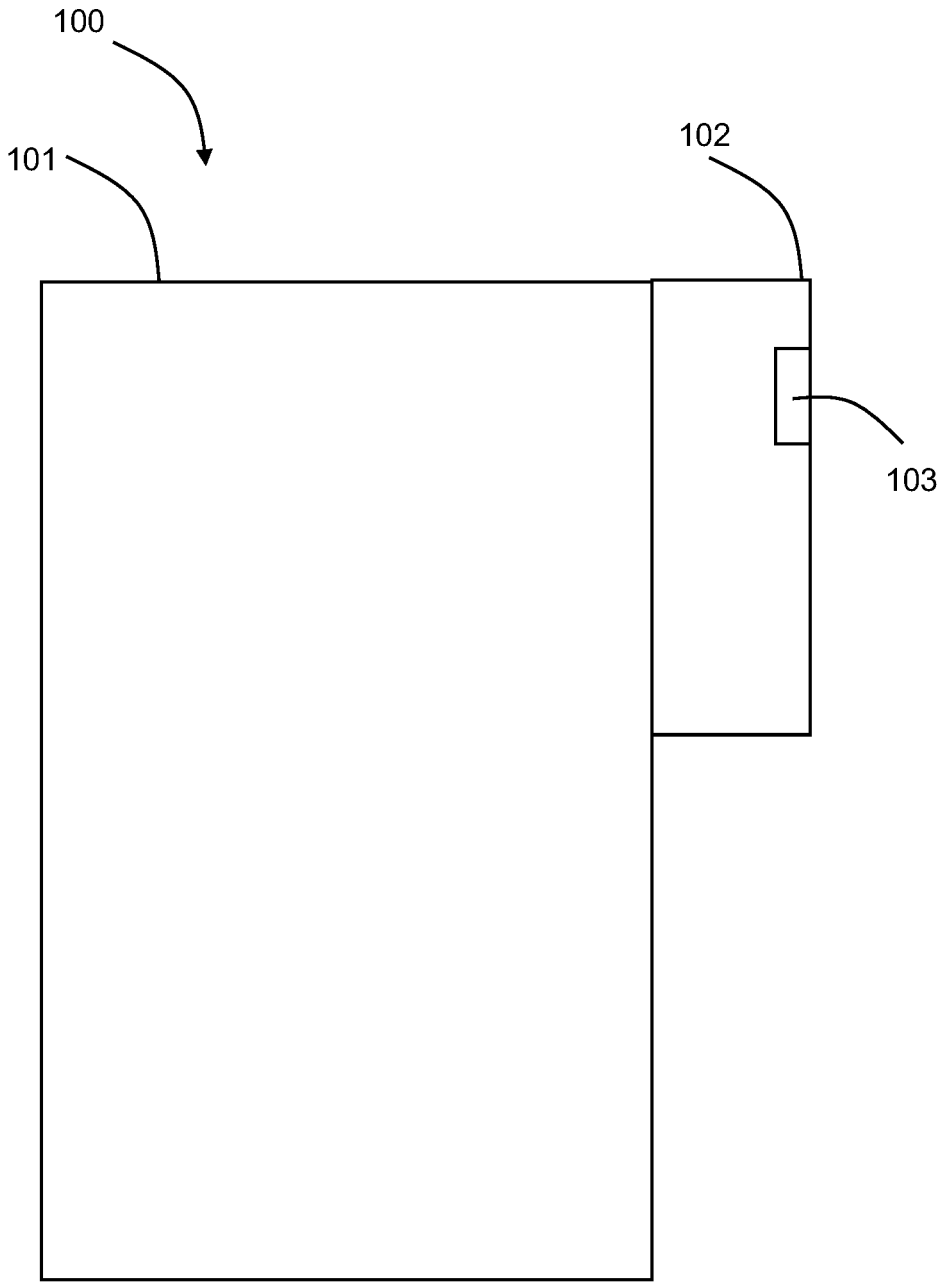
FIG. 1 illustrates example views of an example air conditioner system according to an example embodiment.

Referring to FIG. 1, a system 100 is illustrated in which a view of an example an air conditioner unit 102 is provided. The view of FIG. 1 is provided to illustrate that an enclosure 101 to be cooled by an air conditioner 102, e.g., mounted to the side, as shown in the non-limiting example of FIG. 1, may include a controller 103, e.g., mounted to the inside of the air conditioner 102.

Figure 1A:
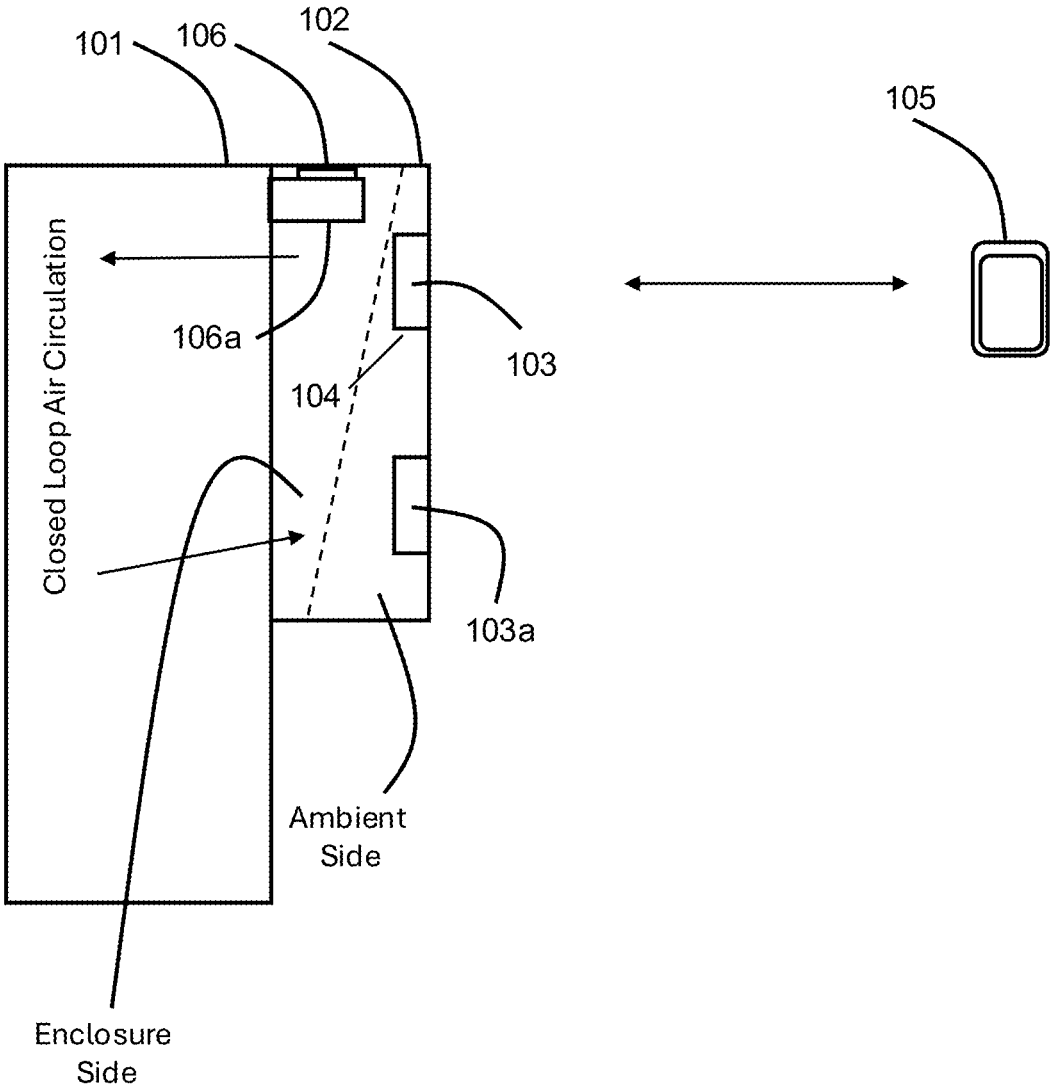
FIG. 1A illustrates an example view of an example air conditioner system and control configurations according to an example embodiment.
Figure 1B:
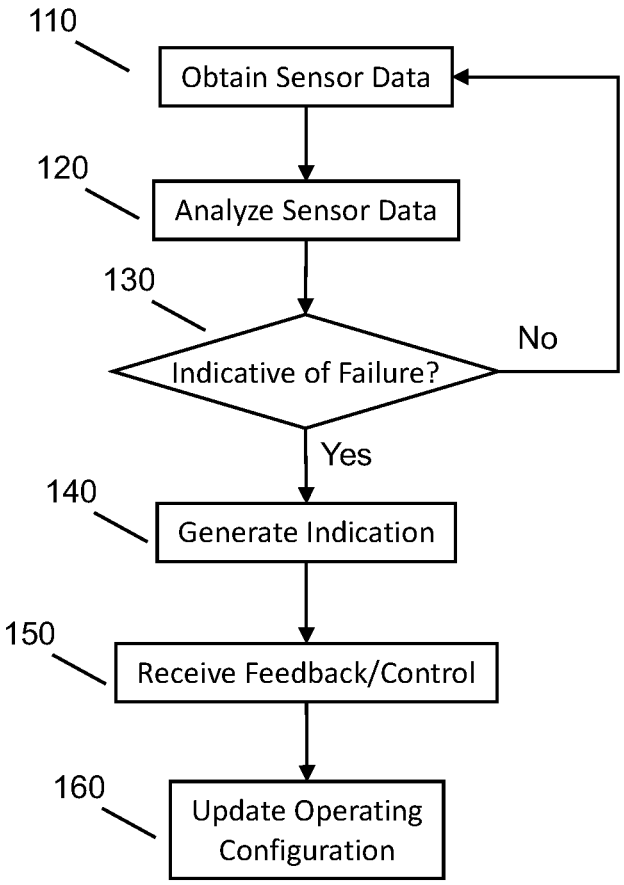
FIG. 1B illustrates an example method according to an example embodiment.

Turning to FIG. 1B, illustrated is the enclosure 101, air conditioner 102, controller 103, and communication element 104 (e.g., Ethernet port, which may be a different or additional port, such as Modbus) for wired communication with a remote device, such as a computer. In addition, as described herein, controller 103 may include various wireless radios or communication elements, e.g., for near field, personal area network, short range wireless, or wireless internet communication with a remote or external device 105 (noting that device 105 may be a mobile device brought into proximity of controller 103 to automate certain communications, e.g., via RFID, near field communication, etc.).

The example air conditioning unit 102 includes cooling components such as a compressor and evaporator needed to condition enclosure 101 air, inlets and returns for taking in enclosure 101 air and returning conditioned air to the enclosure 101.

As shown in FIG. 1, an embodiment includes a digital controller 103 to communicate with the fan(s) internal to the unit, the compressor, and other internal components. The digital controller 103 is used in conjunction with network connectivity, e.g., ethernet, for remote access and alerts, e.g., delivered via text message or email. The controller 103 may be mounted to the air conditioner 102, e.g., inside the air conditioner 102 and out of sight if an external facing controller is not desirable. An internal controller permits the exterior surface of the unit to be free from controller footprint, e.g., allowing a cleaner or clearer exterior design.

In an embodiment, wireless communication is facilitated between the controller 103 and one or more remote devices 105. For example, when near the air conditioning unit 102 and/or controller 103, an operator may connect to the controller 103 wirelessly using a short range or near field wireless communication connection, a BLUETOOTH wireless communication connection, etc. In an embodiment, a remote device 105 used to control the controller 103 and the air conditioning unit 102 may take the form of a tablet computer or a smart phone. In an embodiment, the remote device 105 may have a mobile application installed that permits communication with the controller 103 via one or more appropriate wireless connections, such as via a personal area network such as BLUETOOTH communication or via a wide area network such as the Internet.

In an embodiment, the controller 103 may be programmed to control the air conditioning unit 102 via wireless communication, e.g., via a mobile application and graphical user interfaces (GUIs), such as provided via an ANDROID operating system or IOS mobile application, wired communication, e.g., ethernet, or via manual input, e.g., using a series of dip switches 103*a* provided in association with the controller 103, e.g., in communication with a printed circuit board (PCB) of the controller 103. For example, in an embodiment, the dip switches 103*a* may be reached manually by an operator through an access panel that surrounds the controller 103 to set up the desired temperature set point(s), e.g., if a smart device 105 is not available or preferred for setting or configuring the air conditioning unit 102 wirelessly. The dip switches 103*a* may be associated or connected pins on a PCB of the controller 103, where a set or series of dip switches 103*a* may be used to program set point(s) manually. An embodiment therefore includes both dip switches 103*a* and software configurable controller, e.g., configurable via mobile application or remote device, offering a redundant control feature that may be used alone or in combination with another control feature.

Using a mobile application, the air conditioner 102 can be accessed with a security code or data, e.g., a four-digit security code, and all parameters, including setpoint(s), can be adjusted via the GUI interfaces. If two or more air conditioning units 102 are applied to an implementation, e.g., on or in connection with a single enclosure 101 to be cooled, the set points or other parameters can be configured in combination, e.g., using the mobile application. For example, the setpoint of one air conditioning 102 unit may be set to begin operation (cooling) at a higher temperature if the other, e.g., primary, air conditioner cannot adequately cool the enclosure. The two controllers of the air conditioning units, configured by the user, communicate with one another in a programmed fashion to accomplish such a lead-lag setup. In an embodiment, one or more template GUIs may be provided for the user in the mobile application, e.g., to automate or semi-automate configuring such a lead-lag or other set up arrangement. For example, the units 102 may be associated with one another via proximity to the device running the mobile application 105, and a user may select a template or preconfigured settings to associate the controller(s) 103 of the units 102. In this fashion, a user may not need to enter any data other than confirmation of the predetermined configuration(s) of the template or to adjust a reduced dataset, e.g., enter or adjust set point(s) for the unit(s), indicate a leading or primary unit, indicating a unit as a redundant unit, etc. In an embodiment, after configuration, one or more indicators, such as a light emitting diode, a user interface element, etc., on the air conditioning units may be updated to correspond to the configuration chosen, e.g., indicate a leading unit, to allow the user to confirm the configuration with the equipment.

In an embodiment, current and/or vibration sensor(s) 106 may be used in the air conditioning unit 102 in association with a sensed component 106*a*, such as compressor, a fan, etc., and report data to the controller 103 and/or a remote device, e.g., device 105 running the mobile application. In an embodiment, a current sensor 106 may be utilized to detect current of a component 106*a*, e.g., a compressor, and compare the current to a predetermined threshold or range. Using such data, the controller 103 or other programmable process, e.g., implemented at a remote device 105, may determine that a component 106*a* is out of range, below or above a threshold value, etc. Such a determination may lead to an automated action, e.g., an indication, an alert, an alarm, an automatic configuration adjustment (e.g., change in set point(s)), etc. For example, a given component 106*a* may be expected to draw a certain amount or range or current. If a current sensor 106 reports to the controller 103 that the current is below this value or another value, e.g., a lower threshold, the controller 103 or device in communication there—with may produce an alert or alarm that appears on a remote device 105, e.g., the device that is running the mobile application.

In an embodiment, one or more vibration sensors 106 may also report sensed data to the controller(s) 103, e.g., report vibration data from one or more components 106*a*, such as the fans. In an embodiment, the vibration data may be used to detect a pattern, signature, or amount of vibration from a component such as a fan to indicate the component 106*a* is nearing its end of life. In an embodiment, the vibration sensor data is compared to a known set of vibration data to produce an estimated remaining life, which can be sent as an indication, alert or alarm. In an embodiment, different estimates of remaining life may result in different automated actions, e.g., providing an indication for a first remaining life estimate, thereafter, providing an alert for a reduced remaining life estimate, and providing an alarm and escalation message, e.g., email, text, push notification, email, etc., when end of life estimate is imminent or the component 106*a* has failed. As with other alerts, notifications, and events, event data may be stored, for example in a memory associated with a controller, which may be included in a remote device. This event data may be utilized to determine or inform decisions related to other components, e.g., incorporated into an automated learning process as labeled training data for making classifications.

An embodiment may be provided with alternating current (AC) power, direct current (DC) power, or a combination thereof, for example where DC battery power is provided as a backup power supply. In some embodiments, separate control of AC and DC supplied to the unit 102 is provided via a controller or combination of controllers 103, as described herein.

An embodiment provides an air conditioner 102 that runs on direct current, e.g., 48 vdc, that operates at variable speeds to provide closed-loop cooling. An embodiment may take the form of an inset mounted air conditioner 102 for enclosure 101 cooling.

Variable speed is achieved through a driver that is controlled by a controller 103 with milliamp outputs to the driver that in turn varies the speed of a component 106*a* such as a fan or a compressor. A digital controller or control pad 103 may be provided for manual adjustments or other inputs.

An embodiment employs high and low set points for variable speed control, e.g., according to a control program executed by the controller 103 an/or programmed via dip switches 103*a*. In an embodiment, both the high and low set points are adjustable. Adjusting the low setpoint or the high set point will affect the speed of the compressor and fan(s), as well as how fast the air conditioner 102 ramps up to full speed.

In an embodiment, components 106*a* such as one or more of a compressor and fan(s) are powered on and the speed of the compressor or fan(s), or both, is adjusted based on the set point(s) and the current temperature within the enclosure 101. For example, in an embodiment, ambient side fan(s) vary speed off the low set point and high setpoint to coincide with the compressor and reject heat at variable rates. Enclosure side fan(s) vary speed from the high set point and off setpoint, e.g., which have a seven-degree differential. As the temperature hits the high setpoint, evaporator fan(s) run at full speed and as the low setpoint is approached speed ramps down, allowing for less energy consumption, less noise (fewer decibels), and less heat absorption. When the temperature starts to rise above the off setpoint (e.g., seven degrees below the high setpoint), fan(s) begin to increase speed as the temperature gets closer to the high setpoint. Once the air temperature in the enclosure 101 reaches the high setpoint, the air conditioner 102 is running at full speed. Once temperature in the enclosure 10 lgoes above the low setpoint, the unit 102 will cycle on.

In an embodiment, the enclosure 101 to be cooled is a cellular cabinet or enclosure, for example a 5G telecommunications enclosure. A cellular communications enclosure or cabinet may be located for example in a cellular tower or at or near the top of a building.

In an embodiment, a simple network management protocol (SNMP) module may be included, e.g., within circuitry provided with an embodiment, for supporting an Ethernet connection via an Ethernet port 104. An SNMP module supports a protocol that is common to other cellular cabinet components and network devices, permitting a common communication channel to be utilized for controlling the cooling equipment and other equipment in the cellular cabinet. Likewise, in an embodiment, Modbus 485 protocol, BACnet 485 protocol or another communication protocol may be supported via appropriate ports or interfaces.

In an embodiment, software drives a compressor and allows for automated protocols controlling the system components. In an embodiment, as the system ramps up, the fan speed is advanced as compared to that of the compressor, i.e., the fan is adjusted to increase its speed more than the compressor speed. In an embodiment, when ramping down, the fan speed operates in the opposite manner with respect to the compressor speed.

An embodiment may operate according to one or more automated protocols, which may be adjusted. By way of example, if a set point is at 80° F., a high set point is at 100° F., with the temperature climbing slowly (e.g., less than a degree per minute), a 20 degree temperature range between set points is the time/temperature spread for increasing components such as fan(s) to max speed. In this example, the fan uses the 20-degree spread to ramp the system up as the temperature fluctuates within this temperature range.

In an embodiment, sudden temperature change may be handled differently by controlling software as compared to gradual temperature changes. For example, with a sudden temperature rise, e.g., 5 degrees in under a minute, the fan(s) automatically ramp up more quickly, e.g., to maximum, than would otherwise be the case if the fan(s) were following a slow temperature change protocol. Even in the face of sudden temperature changes, a control protocol may be dynamically adjusted, e.g., based on thermostat feedback, which may be included in or in communication with a digital controller 103. For example, if the fan(s) compensate for the sudden temperature change by slowing the rate of temperature increase, halting temperature increase, or reversing temperature increase, then the fan(s) can slow down to a normal glide path, e.g., along a predetermined or default rate of speed change using a different protocol. In one example, such control may be facilitated by a software program that works in combination with dip switches 103*a*, e.g., software control provides granular control of component(s) 106*a* between set points established by dip switch settings.

In an embodiment, a mechanical overload compressor is combined with an electronic overload protection device. For example, temperature or current overload of the compressor may trip a mechanical overload protection device, e.g., as determined via data of sensor 106, where an electronic overload protection device monitors for over current. An embodiment controls the current by watching for overcurrent or another anomaly. This provides a redundant system of protection.

Adjusting the setpoints to be further away from one another will increase the efficiency of the air conditioner 102 because this allows the compressor and the ambient side fan(s) to modulate to find a balance point in the cooling required and allows for the air conditioner to use less electricity (if a higher capacity is not needed).

In an embodiment, a remote control (e.g., via ethernet data communication) enables control of the speeds and any function of the unit 102 from anywhere in the world through several protocols.

In an embodiment, a touch screen controller, e.g., an LCD touch sensitive smart controller, is provided as a digital controller 103 in a control panel.

An embodiment includes a built in or programmable minimum off cycle to prevent short cycling.

An embodiment includes a high efficiency, variable speed compressor.

In an embodiment, a binary mount allows for the unit 102 to be mounted as an inset vertical mount, partially recessed into the application enclosure 101, or vertical mount, where the mounting surface of the unit 102 is flush to the surface of the application enclosure 101. In an embodiment, the binary mount utilizes removable and adjustable flanges for the inset vertical mount and removable threaded studs for the vertical mount. This increases the versatility of the unit and makes it easy for customers to opt for the inset vertical mount and vertical mount configurations.

In FIG. 1B an example method is illustrated. As indicated, an embodiment may be used to monitor one or more units, e.g., unit 102 of FIG. 1. In the example illustrated in FIG. 1B, the monitoring includes obtaining data, such as obtaining sensor data at 110, e.g., from sensor 106 of FIG. 1A. At 120 the data is analyzed according to a rule, e.g., as indicated in this example analyzed to determine if the data is indicative of failure, as illustrated at 130. If not, the process may loop or continue, as shown.

If the data is indicative of failure, e.g., trending towards a failure condition, out of range, etc., as determined at 130, an indication may be generated at 140. For example, an indication may be provided via wired or wireless communication to a remote device, e.g., remote device 105, displayed on a display panel of controller 103, or a combination of the foregoing. Thereafter, data may be received at 150 to control the unit 102, for example changing a configuration such as a set point, current amount, operating speed of a component, change of state, e.g., standby for permitting component replacement, etc. As may be appreciated, the data may be communicated in a wired or wireless fashion from a remote device to the controller. Additionally or alternatively, manual input to the controller, dips switches, or a combination thereof may be provided to change a configuration of the unit 102 or to otherwise adjust control, e.g., update operating parameters as indicated at 160.

Figure 2:
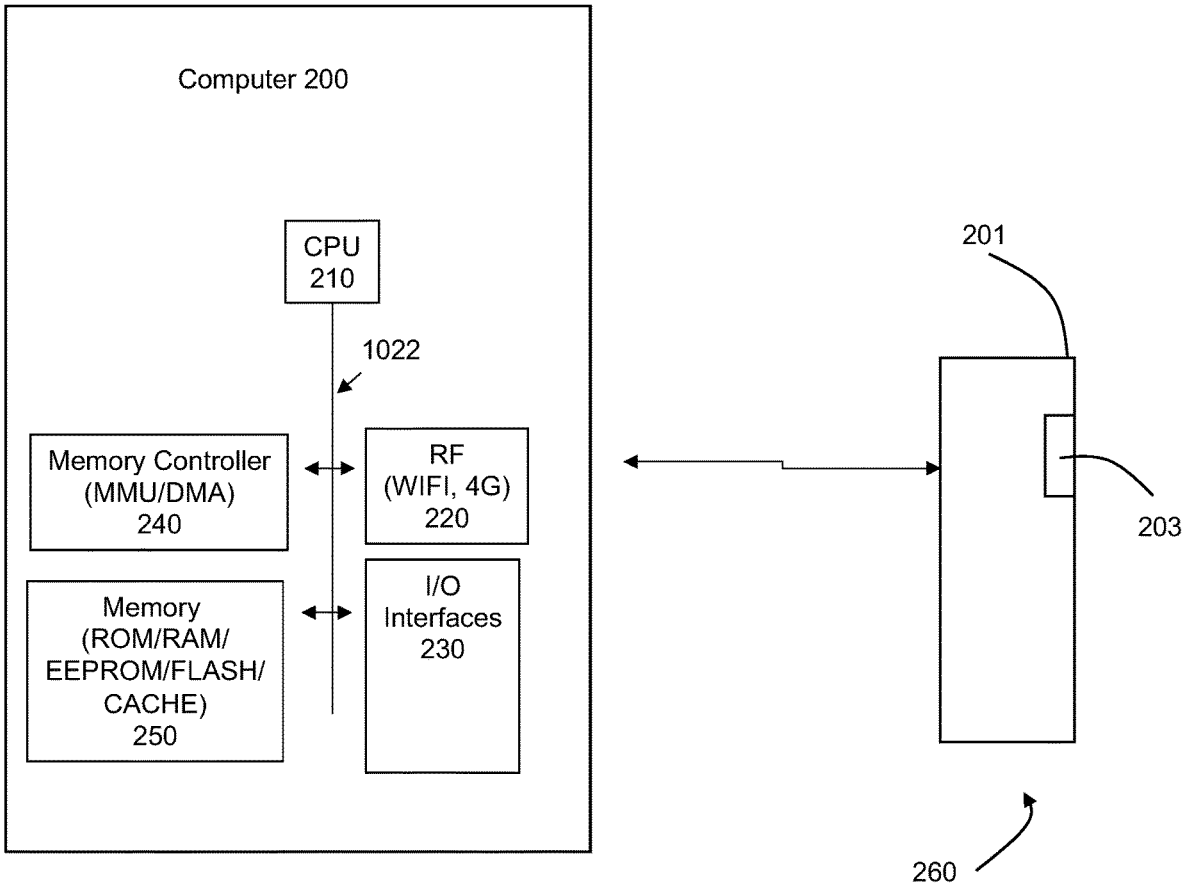
FIG. 2 illustrates an example system according to an example embodiment.

Referring to FIG. 2, an example device that may be used in implementing one or more embodiments includes a device in the form of a computing device (computer) 200, for example included in an embodiment, component thereof such as a controller 103, and/or another system (e.g., a phone, tablet, laptop or desktop computer).

The computer 200 may execute program instructions or code configured to store and process data and perform other functionality of the embodiments, e.g., operate an air conditioning unit or sub components thereof to cool an enclosure using set point(s) temperature(s), generate alarms related to temperature(s), intrusions, etc. Components of computer 200 may include, but are not limited to, a processing unit 210, which may take a variety of forms such as a central processing unit (CPU), a graphics processing unit (GPU), a programmable circuit or other programmable hardware, a combination of the foregoing, etc., a system memory controller 240 and memory 250, and a system bus 222 that couples various system components including the system memory 250 to the processing unit 210. It is noted that in certain implementations, computer 200 may take a reduced or simplified form, such as a micro-control unit implemented in a controller 103 of an air conditioner 102, where certain of the components of computer 200 are omitted or combined.

The computer 200 may include or have access to a variety of non-transitory computer readable media. The system memory 250 may include non-transitory computer readable storage media in the form of volatile and/or nonvolatile memory devices such as read only memory (ROM) and/or random-access memory (RAM). By way of example, and not limitation, system memory 250 may also include an operating system, application programs, other program modules, and program data. For example, system memory 250 may include application programs such as variable speed control software, failure detection programs or modules, and/or air conditioner operational software. Data may be transmitted by wired or wireless communication, e.g., to or from first device to another device, e.g., communication between a remote device or system such as computer 200 and air conditioning system 260, which itself may include a device like the computer 200 in a reduced form, such as in the form of a controller 203.

A user can interface with (for example, enter commands and information) the computer 200 through input devices such as a touch screen, keypad, etc. In certain forms, a user may interface with special purpose hardware, such as aforementioned dip switches 103*a*. A monitor or other type of display screen or device may also be connected to the system bus 222 via an interface, such as an interface 230. The computer 200 may operate in a networked or distributed environment using logical connections to one or more other remote computers or databases. The logical connections may include a network, such local area network (LAN) or a wide area network (WAN) but may also include other networks/buses.

It should be noted that various functions described herein may be implemented using processor executable instructions stored on a non-transitory storage medium or device. A non-transitory storage device may be, for example, an electronic, electromagnetic, or semiconductor system, apparatus, or device, or any suitable combination of the foregoing. More specific examples of a non-transitory storage medium include the following: a portable computer diskette, a hard disk, a random-access memory (RAM), a read-only memory (ROM), an erasable programmable read-only memory (EPROM or Flash memory), a portable compact disc read-only memory (CD-ROM), a solid-state drive, or any suitable combination of the foregoing. In the context of this document "non-transitory" media includes all media except non-statutory signal media.

Program code embodied on a non-transitory storage medium may be transmitted using any appropriate medium, including but not limited to wireless, wireline, optical fiber cable, RF, etc., or any suitable combination of the foregoing.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), a personal area network (PAN) or the connection may be made through other devices (for example, through the Internet using an Internet Service Provider), through wireless connections, or through a hard wire connection, such as over a USB or another power and data connection.

Example embodiments are described herein with reference to the figures, which illustrate various example embodiments. It will be understood that the actions and functionality may be implemented at least in part by program instructions. These program instructions may be provided to a processor of a device to produce a special purpose machine, such that the instructions, which execute via a processor of the device implement the functions/acts specified.

It is worth noting that while specific elements are illustrated in the figures, and a particular ordering or organization of elements or steps has been illustrated, these are non-limiting examples. In certain contexts, two or more elements or steps may be combined into an equivalent element or step, an element or step may be split into two or more equivalent elements or steps, or certain elements or steps may be re-ordered or re-organized or omitted as appropriate, as the explicit illustrated examples are used only for descriptive purposes and are not to be construed as limiting.

As used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected by one skilled in the art without departing from the scope or spirit of the disclosure.

What is claimed is:

1. An air conditioning (AC) device having an AC housing comprising both ambient side and enclosure side components, the AC housing being configured to be separable from, attached to, and interface with, an enclosure comprising heat generating electronics, the AC device comprising:

the AC housing having, in the interior thereof, both an ambient side and an enclosure side, the AC housing comprising:

an evaporator;

a component physically coupled to the AC housing and including one or more of a fan and a compressor;

a sensor disposed in the AC housing and configured to monitor the component; and a digital controller physically coupled to the AC-housing;

the digital controller configured to:

obtain, from the sensor, data indicative of one or more of current and vibration associated with the component;

analyze the data;

determine, based on analyzing the data, that the data indicates that the component may fail; and thereafter provide an indication of failure to a second, remote device.

2. The air conditioning device of claim 1, wherein the indication is provided to one or more remote devices over an internet connection.

3. The air conditioning device of claim 1, wherein the digital controller is configured to receive configuration data for configuring one or more set points for the air conditioning device.

4. The air conditioning device of claim 3, wherein the configuration data is received from a mobile device.

5. The air conditioning device of claim 4, wherein the configuration data received from the mobile device is derived from one or more templates associated with one or more predetermined operating scenarios.

6. The air conditioning device of claim 5, wherein the one or more predetermined operating scenarios comprises a lead-lag operating scenario.

7. The air conditioning device of claim 3, wherein the configuration data is received via manual input.

8. The air conditioning device of claim 7, comprising one or more dip switches, wherein the manual input configures the one or more dip switches.

9. The air conditioning device of claim 3, wherein the digital controller is configured to detect the configuration data responsive to bringing a predetermined mobile device into proximity of the air conditioning device.

10. A system, comprising:

the air conditioning device of claim 1; and a mobile application comprising one or more templates for receiving configuration data associated with one or more predetermined operating scenarios.

11. A system, comprising:

the air conditioning device of claim 1; and the enclosure.

* * * * *